US006810129B2

(12) United States Patent
Nakada

(10) Patent No.: US 6,810,129 B2
(45) Date of Patent: Oct. 26, 2004

(54) WATERPROOF SPEAKER FOR USE IN AN AUTOMOBILE

(75) Inventor: Tsuyoshi Nakada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 105 days.

(21) Appl. No.: 10/221,857

(22) PCT Filed: Jan. 26, 2001

(86) PCT No.: PCT/JP01/00551

§ 371 (c)(1),
(2), (4) Date: Sep. 17, 2002

(87) PCT Pub. No.: WO02/060219

PCT Pub. Date: Aug. 1, 2002

(65) Prior Publication Data

US 2003/0091212 A1 May 15, 2003

(51) Int. Cl.[7] ..... H04R 9/06; H04R 1/00

(52) U.S. Cl. ..... 381/433; 381/389; 381/395; 181/149

(58) Field of Search ..... 381/86, 302, 334, 381/336, 386, 388, 389, 396, 433; 181/149, 150, 171, 172, 199

(56) References Cited

U.S. PATENT DOCUMENTS 6,349,142 B1 * 2/2002 Teng ..... 381/386
6,607,051 B1 * 8/2003 Peng ..... 181/171

FOREIGN PATENT DOCUMENTS

| | | |
|---|---|---|
| JP | 59-73886 | 5/1984 |
| JP | 7-42286 | 7/1995 |
| JP | 8-79866 | 3/1996 |

* cited by examiner

*Primary Examiner*—Curtis Kuntz
*Assistant Examiner*—Brian Ensey
(74) *Attorney, Agent, or Firm*—Birch, Stewart, Kolasch & Birch, LLP

(57) ABSTRACT

A damper-mounting wall portion 40 which is provided on a small-diameter end of a trumpet-shape part of a frame 1 so as to extend in a diametrically inward direction is formed with an outside diameter which is larger than a diameter of a damper 8 which is adhered thereto. On a peripheral edge portion of the damper-mounting wall portion 40, there is integrally formed an annular eave-shaped barrier wall portion 41 which extends in an axial direction toward the front side of the frame 1 so as to enclose the circumference of the damper 8 at a position away from the periphery of the damper 8.

5 Claims, 8 Drawing Sheets

WATERPROOF SPEAKER FOR USE IN AN AUTOMOBILE

TECHNICAL FIELD

The present invention relates to a speaker for automobile use of a waterproof structure which is assembled into an inside of a door of an automobile.

BACKGROUND ART

Generally, since this kind of speaker for automobile use is assembled into a position below a window glass inside a door of an automobile, waterproofing measure comes to be taken to prevent the rain water or car-washing water or the like, from getting into important vibration elements of the speaker along the window glass. Concrete examples thereof will be given hereafter.

FIG. 1 is a schematic cross sectional view to show a conventional ordinary automobile-mounted speaker, and FIG. 2 is an external view of FIG. 1. In the figures, reference numeral 1 denotes a frame of the automobile-mounted speaker. This frame 1 is formed into a trumpet shape having a plurality of openings $\mathbf{2}_1$–$\mathbf{2}_4$. Reference numeral 3 denotes an outward-looking front-end flange which is integrally formed around a peripheral edge of a front-end opening. Reference numeral 4 denotes an annular wall portion bent from the rear end of the trumpet-shape part of the frame 1 in a diametrically inner direction so as to be positioned near the rear portion of the openings $\mathbf{2}_1$–$\mathbf{2}_4$. This annular wall portion 4 serves as an area for adhering a damper thereto, which will be described later. Reference numeral 5 denotes a rear-end stepped portion which is bent from the inner peripheral edge portion of the annular wall portion 4 in an axially outward direction. At the rear-end peripheral portion of this rear-end annular stepped portion 5, there is formed an annular rear wall portion 6 which is bent in the diametrically inward direction.

Reference numeral 7 denotes a cone paper (vibrating diaphragm) whose peripheral edge portion is adhered to the front-end opening edge portion of the frame 1. Reference numeral 8 denotes the damper whose peripheral edge portion is adhered to a front face of the annular wall portion 4. The cone paper 7 and the damper 8 are integrally connected to a bobbin 9 at the respective central portions.

Reference numeral 10 denotes a magnetic circuit unit which is mounted on the rear wall portion 6 of the frame 1. This magnetic circuit unit 10 is to resonate the damper 8 and the cone paper 7 through the bobbin 9, and is made up of a ring-shaped magnet 11, first and second magnetic members 12, 13 which sandwich the magnet 11, and a voice coil 14. At this point the first magnetic member 12 is formed into a projected shape in cross section having a central axial portion 12*a* which is coaxial with the bobbin 9. The second magnetic member 13 is made of a ring plate which is fitted into the central axial portion 12*a* of the first magnetic member 12. The voice coil 14 is interposed between the central axial portion 12*a* and the second magnetic member 13. The voice coil 14 is arranged to be energized.

The speaker for automobile use having the above described arrangement is set in position by assembling the front-end flange 3 of the frame 1 to a metal plate below the window glass inside the door of the automobile. In order to cover the metal plate, an interior decorating plate is attached to the door, and an opening for the speaker in the interior decorating plate and the speaker having adhered thereto a gasket 15 are set in position close to each other.

Next, a description will now be made about the operation.

The sound is generated by a vibration of the cone paper 7 and the damper 8 through the bobbin 9 by means of audio current at the time of energization of the voice coil 14.

Since the conventional ordinary speaker for automobile use has the above described arrangement, there was a problem that the rain water or car-washing water which enters the inside of the door through the window glass of the door at the time of rainy weather or at the time of car washing, splashes onto the speaker thereby resulting in a deterioration of the speaker characteristics or performance.

In other words, the rain water or car-washing water is likely to enter from the openings $\mathbf{2}_1$–$\mathbf{2}_4$ which are opened at the trumpet-shape part of the frame 1 (especially from the upper and left and right openings $\mathbf{2}_1$–$\mathbf{2}_3$) so as to be positioned below the window glass of the automobile door. Due to water impregnation by the entered water into the water-absorbing cone paper 7 and the damper 8, there were problems that the resonance characteristics of the cone paper 7 and the damper 8 get deteriorated, that the amount of water impregnation gradually increases and the penetrated water finds its way into the magnetic circuit unit 10 to thereby generate abnormal noises, and that rust is formed inside the magnetic circuit unit 10.

In order to solve the above described problems, there has been proposed a speaker for automobile use with a waterproof cover.

FIG. 3 is a perspective view to show a conventional speaker for automobile use with a waterproof cover. The same reference numerals have been given to the same constituent parts as those in FIGS. 1 and 2 and further descriptions on them have been omitted. In FIG. 3, reference numeral 16 denotes the waterproof cover mounted on a rear side of the frame 1. This waterproof cover 16 covers the upper, left and right openings $\mathbf{2}_1$–$\mathbf{2}_3$ which are formed in the trumpet-shape part of the frame 1 as shown in FIGS. 1 and 2, and also covers the magnetic circuit unit 10 in the rear portion.

By means of covering the rear side of the frame 1 with the waterproof cover 16 as described above, the rain water or the car-washing water that has entered the inside of the door along the window glass is prevented from splashing onto the essential vibrating elements of the speaker or from penetrating into the magnetic circuit unit 10 through the openings $\mathbf{2}_1$–$\mathbf{2}_3$.

Since the conventional speaker for automobile use with the waterproof cover has the above described arrangement, there was a problem that the waterproof cover 16 which covered from the front-end flange 3 of the frame 1 to the rear end of the magnetic circuit unit 10 itself became large in size, thereby resulting in an increase of cost. Further, since the large-sized waterproof cover 16 becomes occupying larger area for the assembled speaker, there was a problem that the place for assembled speaker to be attached was limited.

As another example of conventional speaker with the waterproof cover, Laid Open Japanese Utility Model No. 42286/1995 discloses a speaker for automobile use with waterproof structure which does not require the waterproof cover portion of a separate constituent part. In this automobile-mounted speaker, a partial waterproof cover which shields a space between the upper opening of the frame and the upper edge portion of the damper by means of bending forward, is integrally formed on a substantially semicircular edge portion on the upper side of the damper-mounting wall portion of the frame which is formed into a trumpet-shape having a plurality of openings.

In this conventional example, however, substantially the entire surface of the damper-mounting wall portion of the frame serves as the damper adhering area. Since the upper edge portion of the damper which is adhered to the damper-mounting wall portion is positioned closely to the waterproof cover portion, the water splashing from the upper opening onto the waterproof cover portion or the water entering from the upper opening by splashing at the magnetic circuit unit, get included into the damper by rolling over the waterproof cover portion. As a result, a problem arises that there is a higher possibility of the speaker characteristics' getting deteriorated by the wetting of the damper. Further, the waterproof cover portion is integrally formed only on the upper edge portion of the damper-mounting wall portion. Therefore, the orientation which the speaker can be mounted is restricted, and it requires an accuracy to mount the speaker. Therefore, there is a problem that the operability of mounting the speaker is lowered.

The present invention has been made to solve the above described and other problems, and it has an object to provide a speaker for automobile use by which the rain water or the car-washing water can be effectively prevented from splashing onto the essential speaker constituent parts without requiring a waterproof cover as a separate constituent part, and at the same time by which the operability for mounting the speaker is improved without restriction to the orientation for mounting the speaker.

Further, the present invention has an object to provide a speaker for automobile use which more effectively enhances the waterproofing property of the essential speaker constituent parts by means of partly closing the openings with the wall portion of the speaker frame itself without requiring the waterproof cover as a separate constituent part, and at the same time which also decreases the deterioration of the sound quality.

Still further, the present invention has an object to provide a speaker for automobile use in which the water penetrating into the bottom between the rear wall portion of the speaker frame and the damper are not accumulated there.

Furthermore, the present invention has an object to provide a speaker for automobile use in which the place for assembled speaker to be attached is not restricted by the waterproof member though the waterproof member is assembled as a separate constituent part, and at the same time the waterproof member can be easily mounted also on a conventional speaker.

DISCLOSURE OF INVENTION

A speaker for automobile use relating to the present invention a speaker for automobile use includes: a frame which is formed into a trumpet shape having a plurality of openings and which is provided on a small-diameter side of the trumpet-shape part with a damper-mounting wall portion extending in a diametrically inward direction; a damper whose peripheral edge portion is adhered to the damper-mounting wall portion; a vibrating diaphragm provided so as to extend over a front side of the frame; and a magnetic circuit unit which is mounted on a rear face side of the frame so as to vibrate the damper and the vibrating diaphragm; it is characterized in that the damper-mounting wall portion is formed with a diameter larger than a diameter of the damper, and that an annular eave-shaped barrier wall portion which axially extends toward the front side of the frame so as to enclose a circumference of the damper at a position away from the peripheral edge portion of the damper is integrally formed in a peripheral edge portion of the damper-mounting wall portion.

According to the speaker for automobile use having the above described arrangement, by the annular eave-shaped barrier wall portion which is formed integral with the damper-mounting wall portion of the frame, the rain water or the car-washing water entering the inside of the door of the automobile is prevented from splashing onto the damper through the openings of the frame. Therefore, a waterproof cover as a separate constituent part is eliminated, with the result that the cost is reduced and the size of the speaker is minimized, and also that the restriction on the place for assembled speaker to be attached can be alleviated. Still further, since the barrier wall portion having the above described arrangement does not restrict the orientation in which the speaker is mounted, there is an effect that the flexibility of the assembling of the speaker is improved.

Especially, the above described barrier wall portion is formed larger in outer diameter than the diameter of the adhered damper in the damper-mounting wall portion so as to enclose the damper at a position away from the outer peripheral portion of the damper. Therefore, a frequency is largely reduced that the water falling onto the barrier wall portion through the openings of the frame or the water entering through the openings by splashing on the magnetic circuit unit gets attached to the damper or to the vibrating diaphragm (cone paper). As a result, there is an effect that the deterioration of the speaker characteristics can be effectively prevented.

In the speaker for automobile use relating to the present invention, a barrier wall portion is formed substantially at a right angle to the damper-mounting portion of the frame.

According to the speaker for automobile use having the above described arrangement, there is an effect that the water falling through the openings of the frame onto the barrier wall portion or the water entering through the openings by splashing on the magnetic circuit unit is prevented from reaching the damper by the surface tension thereof along the barrier wall portion.

In the speaker for automobile use relating to the present invention, an upper side of the trumpet-shape part of the frame is formed as a cover wall portion free from an opening.

According to the speaker for automobile use having the above described arrangement, a larger area free from an opening can be secured at an upper side of the trumpet-shape portion of the frame. Therefore, there is an effect that the water is more effectively prevented from splashing from above the trumpet-shape part onto the damper or onto the vibrating diaphragm.

In the speaker for automobile use relating to the present invention, the frame is provided with openings which open at left, right and lower sides respectively, except at an upper side, of the trumpet-shape part, and the damper-mounting wall portion and the barrier wall portion are provided at each lower side thereof with a crena portion which is in continuation of the opening on the lower side.

According to the speaker for automobile use having the above described arrangement, while the upper-side wall portion of the trumpet-shape part of the frame can be utilized as a cover wall portion above the damper, the area of opening of the upper wall portion is reduced. However, due to the crena portions provided at the lower side of the respective damper-mounting wall portion and the barrier wall portion, the area of opening on the lower side is enlarged. Therefore, there is an effect that the deterioration of the sound quality is reduced. Furthermore, there is an effect that the water entering into the inside of the eave-shaped barrier wall portion can be discharged out of the crena portions.

A speaker for automobile use relating to the present invention includes: a frame which is formed into a trumpet shape having a plurality of openings and which is provided on a small-diameter side of the trumpet-shape part with a damper-mounting wall portion extending in a diametrically inward direction; a damper whose peripheral edge portion is adhered to the damper-mounting wall portion; a vibrating diaphragm provided so as to extend over a front side of the frame; and a magnetic circuit unit which is mounted on a rear face side of the frame so as to resonate the damper and the vibrating diaphragm; it is characterized in that on a rear side of the damper-mounting wall portion, there is assembled an annular waterproofing member having barrier piece portions each extending axially forward through each of the openings so as to intermittently enclose a circumference of the damper.

According to the speaker for automobile use having the above described arrangement, although the waterproof member as a separate constituent part is required, this waterproof member may be simple in shape and small in size and thereby it is assembled into the rear side of the damper-mounting wall portion so that the barrier piece portions are protruded forward through the openings. Therefore, there can be obtained an effect that the place for assembled speaker to be attached is not restricted by the waterproof member.

In the speaker for automobile use relating to the present invention, the waterproof member is held in position by insertion into an annular stepped portion which is formed in an inner peripheral edge portion of the damper-mounting wall portion and extending axially backward.

According to the speaker for automobile use having the above described arrangement, there is an effect that only by fitting the waterproof member into the annular stepped portion on the rear of the damper-mounting wall portion, the waterproofing member can be easily assembled into the frame.

In the speaker for automobile use relating to the present invention, the waterproof member has an annular peripheral wall portion and a fitting crena portion for fitting into each of supporting portions between respective openings of the frame are formed at the annular peripheral wall portion.

According to the speaker for automobile use having the above described arrangement, by fitting the crena portions of the waterproof member into the bridge wall portions of the frame, there is an effect that the peripheral wall portions of the waterproof member can be protruded forward respectively through the openings of the frame as barrier pieces for waterproofing the damper, and in addition, that the waterproofing member can be stably held in position by the frame in that state.

BEST MODE FOR CARRYING OUT THE INVENTION

In order to describe the present invention in more detail, a description will now be made about the best mode for carrying out the present invention with reference to the accompanied drawings.

Embodiment 1

Figure 4:
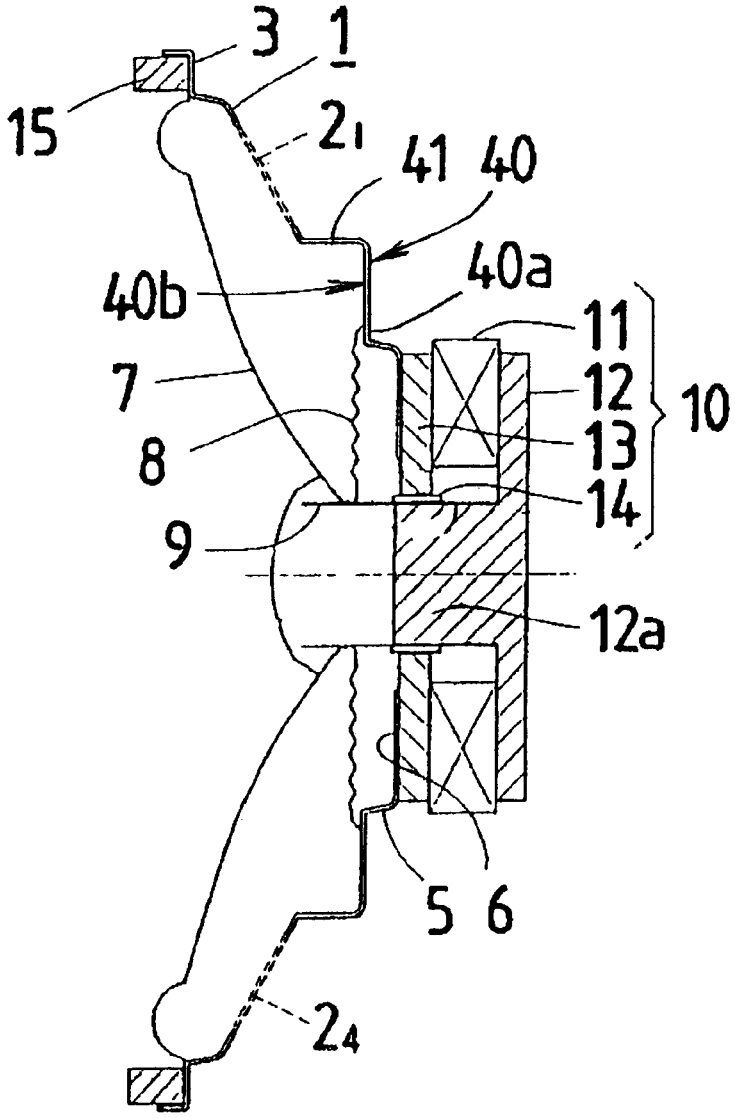
FIG. 4 is a schematic cross sectional view to show a speaker for automobile use according to an embodiment 1 of the present invention.
Figure 5:
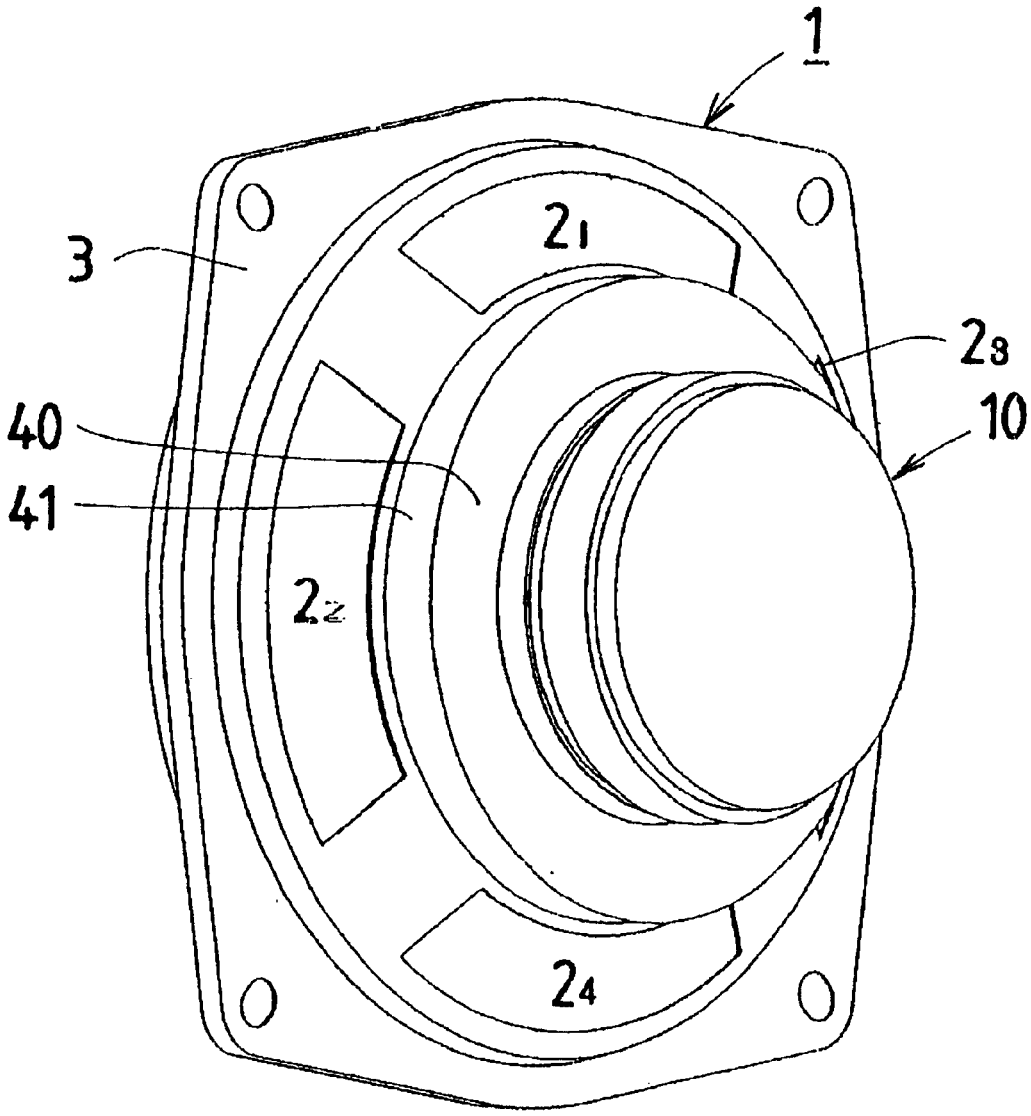
FIG. 5 is a perspective view of the speaker for automobile use in FIG. 4 as seen from the rear side.

FIG. 4 is a schematic cross sectional view to show a speaker for automobile use according to an embodiment 1 of the present invention and FIG. 5 is a perspective view of the speaker for automobile use in FIG. 4 as seen from a rear side thereof.

In the figures, reference numeral 40 denotes a damper-mounting wall portion which is integrally formed on a small-diameter side of a trumpet-shape part of a frame 1 so as to extend diametrically inward, and a peripheral portion of a damper 8 is adhered to a front face of the damper-mounting wall.

The damper-mounting wall portion 40 of the above described structure is formed with a larger outer diameter than a diameter of the damper 8.

Therefore, the above described damper-mounting wall portion 40 has a damper adhering area 40*a* to which the damper 8 is adhered, and a surplus area 40*b* which is free from adhering of the damper 8.

At this point the surplus area 40*b* of the damper-mounting wall portion 40 is formed larger in space in the diametrical direction than is the damper adhering area 40*a*.

Reference numeral 41 denotes a barrier wall portion which is in continuation of a peripheral edge portion of the damper-mounting wall portion 40. This barrier wall portion 41 extends from the peripheral edge portion of the damper-mounting wall portion 40 axially forward of the frame 1, and is formed into an annular eave-shape which surrounds the circumference of the damper 8 at a position away from the peripheral edge portion of the damper 8 by a diametrical dimension equivalent to the above described surplus area 40*b*.

Figure 1:
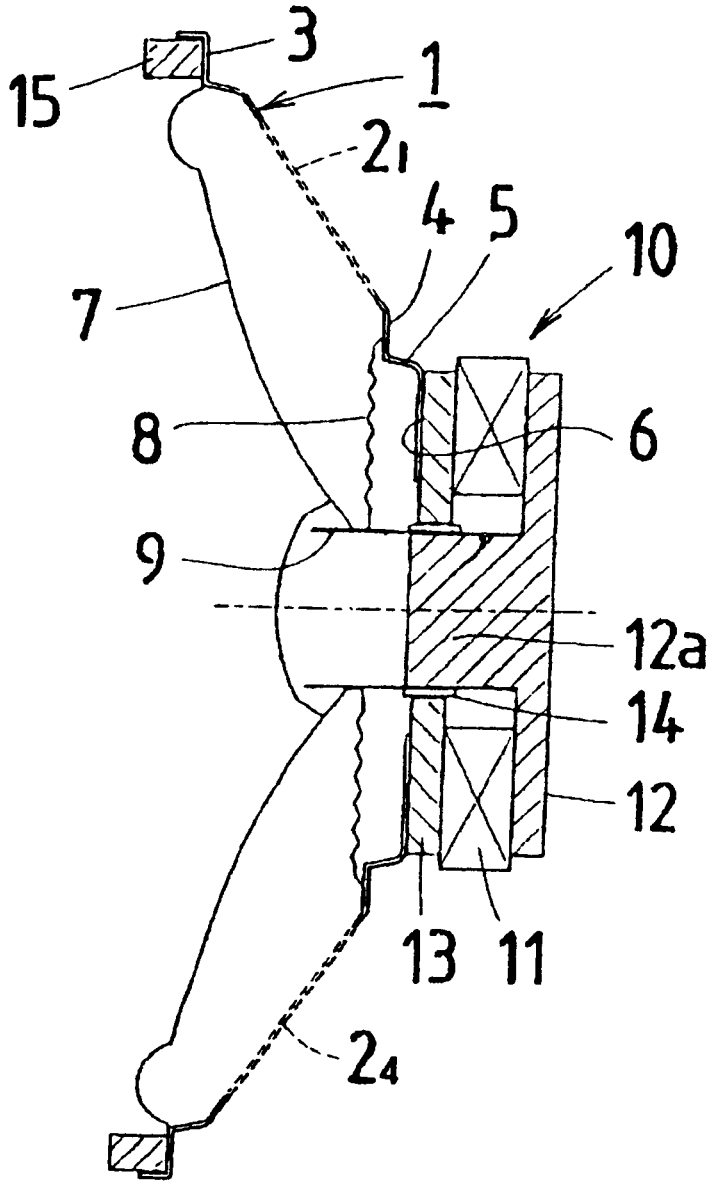
FIG. 1 PRIOR ART
FIG. 1 is a schematic cross sectional view to show a conventional ordinary speaker for automobile use.
Figure 2:
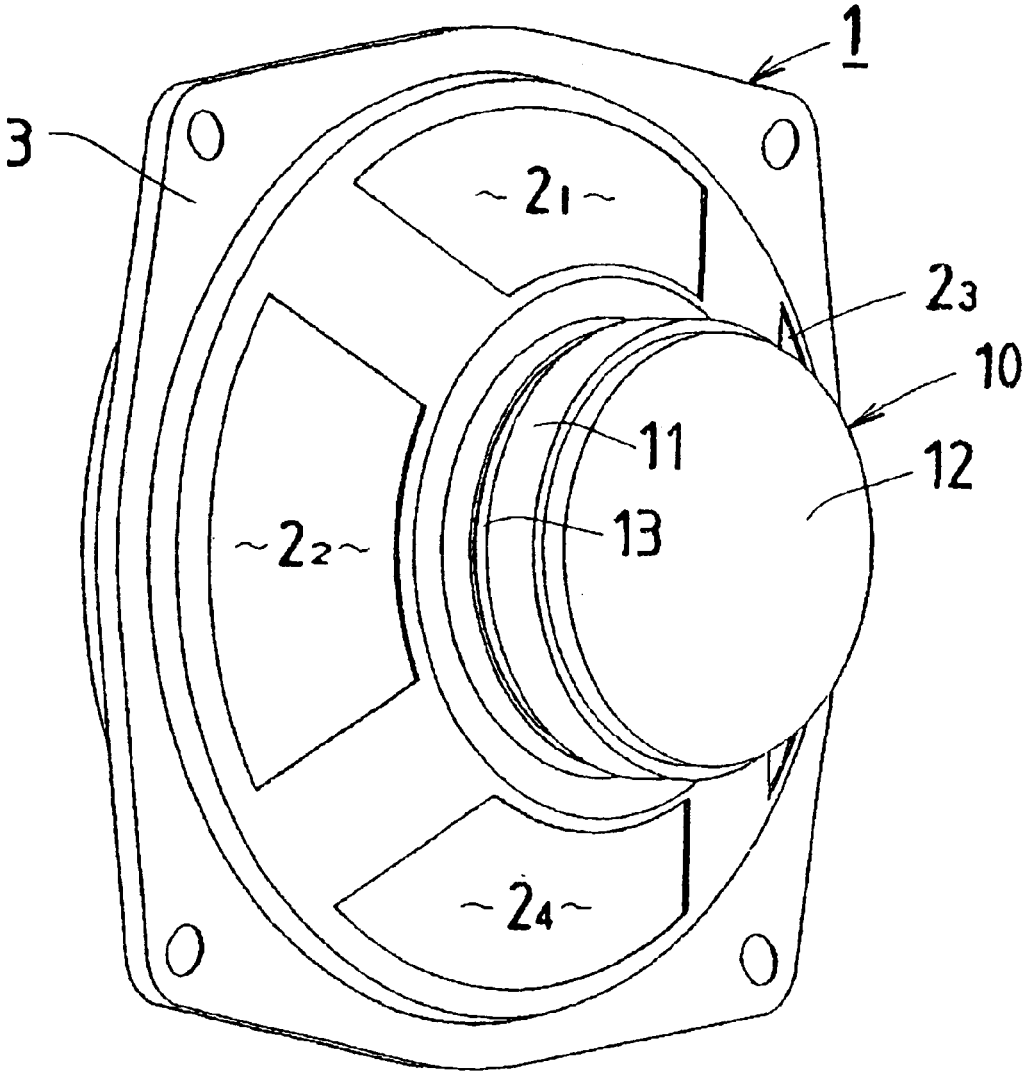
FIG.2 PRIOR ART
FIG. 2 is a perspective view of the speaker for automobile use in FIG. 1 as seen from the rear side.

The other structures of the speaker for automobile use according to embodiment 1 are quite the same as those in FIGS. 1 and 2. Therefore, the same reference numerals have been assigned to the same constituting elements and further descriptions on them are omitted.

Figure 3:
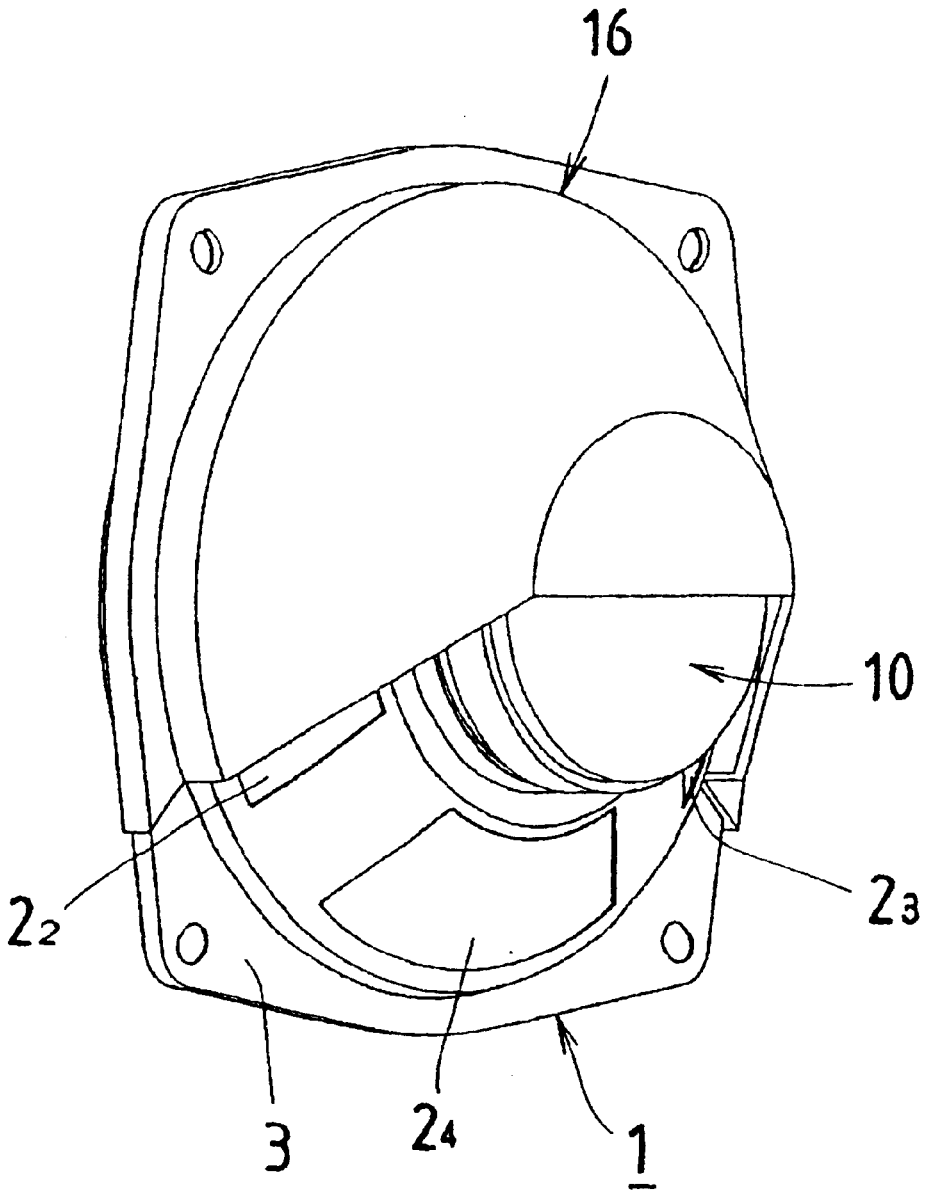
FIG.3 PRIOR ART
FIG. 3 is a perspective view of a conventional speaker for automobile use with a waterproof cover as seen from the rear side.

As described above, according to embodiment 1 by means of the annular eave-shaped barrier wall portion 41 which is formed in continuation of the peripheral edge portion of the damper-mounting wall portion 40 of the frame 1 so as to extend axially forward of the frame 1, the rain water or automobile-washing water to enter the inside of a door of the automobile is prevented from splashing from the upper, left and right openings $\mathbf{2}_1$–$\mathbf{2}_3$ of the frame onto the damper 8. As a result, since the waterproof cover as a separate part as shown in FIG. 3 can be eliminated, the speaker is reduced in cost and weight and the restriction of the place for assembled speaker to be attached is alleviated. In addition, since the barrier wall portion 41 which is formed into an annular eave-shape does not restrict the orientation in which the speaker is mounted as described above, there is an effect that the operability in assembling of the speaker is improved.

In particular, in the above described embodiment 1, by means of forming the barrier wall portion 41 with an outer diameter which is larger than the diameter of the damper 8 that is adhered to the damper-mounting wall portion 40, the damper-mounting wall portion 40 has the damper adhering area 40*a* and the surplus area 40*b*. By forming the surplus area 40*b* larger in the diametrical direction than the damper adhering area 40*a*, the above described barrier wall portion 41 encloses the circumference of the damper 8 at a position largely away from the outer peripheral edge portion of the damper 8 by the diametrical distance equivalent to the surplus area 40*b* of the damper-mounting wall portion 40. Therefore, the above described barrier wall portion 41 can effectively prevent the adhesion of the water splashing from the openings $\mathbf{2}_1$–$\mathbf{2}_3$ onto the barrier wall portion 41 or the water entering through the openings $\mathbf{2}_1$–$\mathbf{2}_3$ by bouncing at the magnetic circuit unit 10. There is thus an effect that the frequency of adhering of the water to the damper 8 can be largely reduced.

Embodiment 2

The speaker for automobile use according to embodiment 2 is made by forming the barrier wall portion 41 according to the above described embodiment 1 substantially at a right angle to the damper-mounting wall portion 40.

In other words, in case the above described barrier wall portion 41 is inclined in the same direction as the trumpet-shape part of frame 1, the water falling along the frame 1 sometimes comes into the inside of the speaker due to surface tension, so that the water is collected in a lower portion of the damper 8. If the water is collected in the lower portion of the damper 8, the amount of water absorption into the damper 8 increases accordingly, resulting in deterioration of the resonating characteristics of the damper 8 and the cone paper 7. Further, the water entering the inside of the speaker along the frame 1 also penetrates by surface tension into the voice coil 14 of the magnetic circuit unit 10. With the increase in the amount of water penetration into the voice coil 14, there will occur an unusual noise or corrosion inside the magnetic circuit unit 10.

Therefore, according to embodiment 2, by means of forming the barrier wall portion 41 and the damper-mounting wall portion 40 substantially at a right angle to each other, the frequency of water's falling along the frame 1 into the inside of the speaker due to surface tension becomes smaller, and the amount of water adhered to the damper 8 largely decreases. Therefore, the amount of water adhered to, and penetrating into the damper 8 and the amount of water entering the magnetic circuit unit 10 can be respectively largely reduced. The deterioration of the resonating characteristics of the damper 8 and the cone paper 7 can be restricted, and the occurrence of unusual noises and the corrosion inside the magnetic circuit unit 10 can also be prevented, thereby resulting in an effect that the deterioration in speaker characteristics can be restricted.

Embodiment 3

Figure 6:
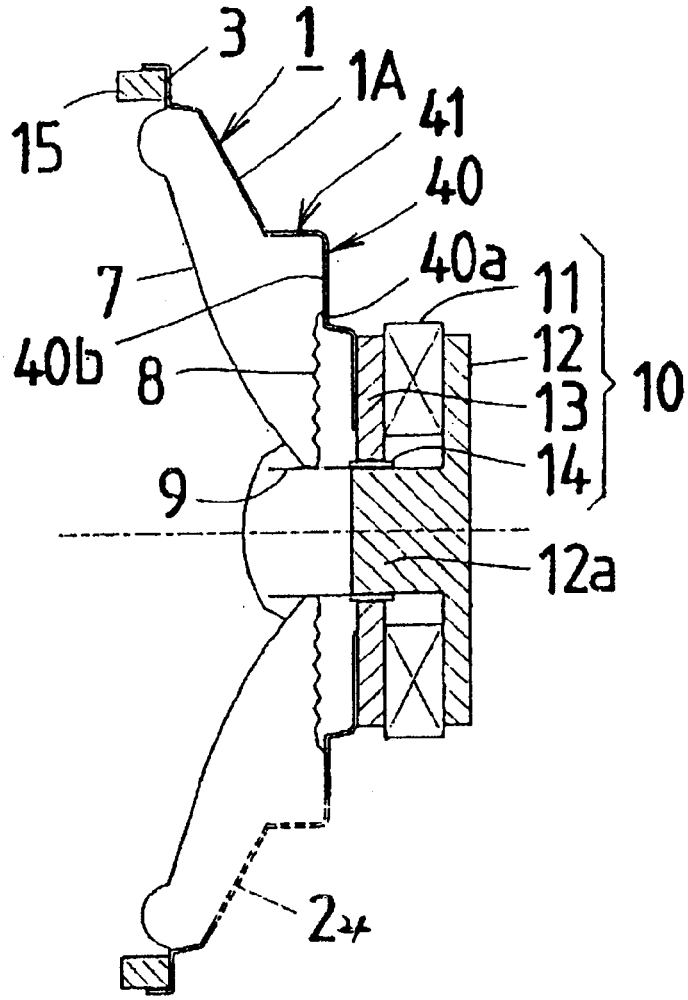
FIG. 6 is a schematic cross sectional view to show a speaker for automobile use according to an embodiment 3 of the present invention.
Figure 7:
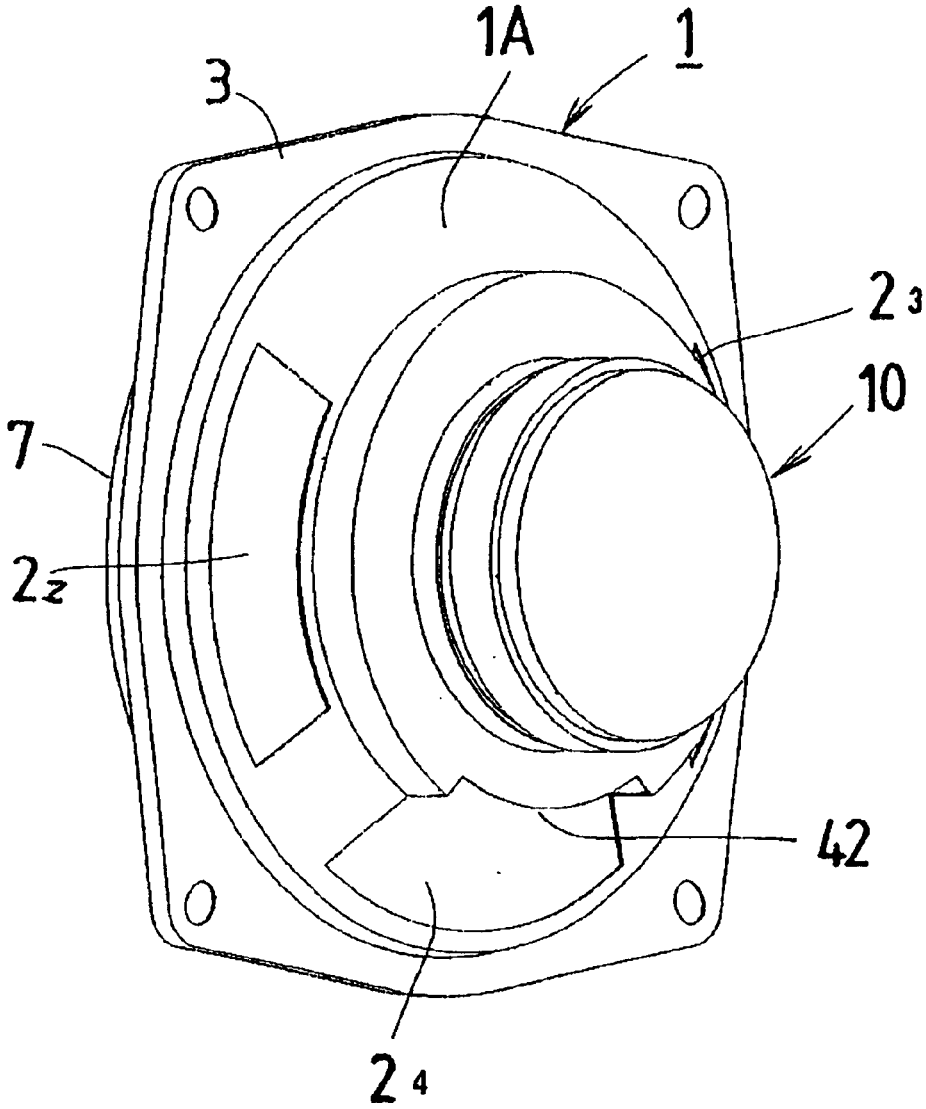
FIG. 7 is a perspective view of the speaker for automobile use in FIG. 6 as seen from the rear side.

FIG. 6 is a schematic cross sectional view to show a speaker for automobile use according to an embodiment 3 of the present invention and FIG. 7 is a perspective view as seen from a rear side of the speaker for automobile use in FIG. 6.

In the figures, reference numeral 1A denotes a cover wall portion which is formed on an upper side (above the barrier wall portion 41) in a trumpet-shape part of a frame 1. Reference numeral 42 denotes a crena portion which is formed in a lower portion of the damper-mounting wall portion 40 and the barrier wall portion 41 respectively. This crena portion 42 is formed in continuation of the opening 24 at the lower portion of the frame 1.

In other words, in this embodiment 3, at the trumpet-shape portion of the frame 1, the portion above the left and right openings 22, 23 is formed as a wall portion 1A free from an opening as shown in FIG. 7, and at the same time the crena portion 42 which is in continuation of the upper portion of the lower opening 24 of the frame 1, is formed at the bottom portion of the annular eave-shaped barrier wall portion 41 and the bottom portion of the damper-mounting wall portion 40.

The other structures of this speaker for automobile use according to this embodiment 3 are the same as those of embodiment 1 as shown in FIGS. 4 and 5, therefore the same reference numerals have been attached to the same constituent elements to thereby omit the further description thereaof.

According to embodiment 3 as described above, since the space between the left and right openings 22, 23 at the trumpet-shape part in frame 1 is formed as the cover wall portion 1A of a larger area which is free from an opening so that the cover wall portion 1A covers the upper portions of the cone paper 7 and the damper 8, respectively, there is thus an effect that the falling water from above the frame 1 does not splash onto the cone paper 7 and the damper 8. In addition, since there is no upper opening of the trumpet-shape portion of the frame 1, the total area of the left, right and lower three openings 22–24 which open in the trumpet-shape part of the frame 1 of embodiment 3 becomes smaller than the total area of upper, lower, left and right four openings $\mathbf{2}_1$–$\mathbf{2}_4$ as shown in FIGS. 4 and 5. However, since the reduced amount of openings is supplemented by the crena portion 42, there is an effect that the deterioration in sound quality is restricted. Further, should the water enter the inside of the speaker, the entered water is discharged from the above described crena portion 42. There is therefore no possibility of the staying of water in the bottom of the speaker. There is thus an effect that the deterioration of the speaker characteristics can be restricted.

Embodiment 4

Figure 8:
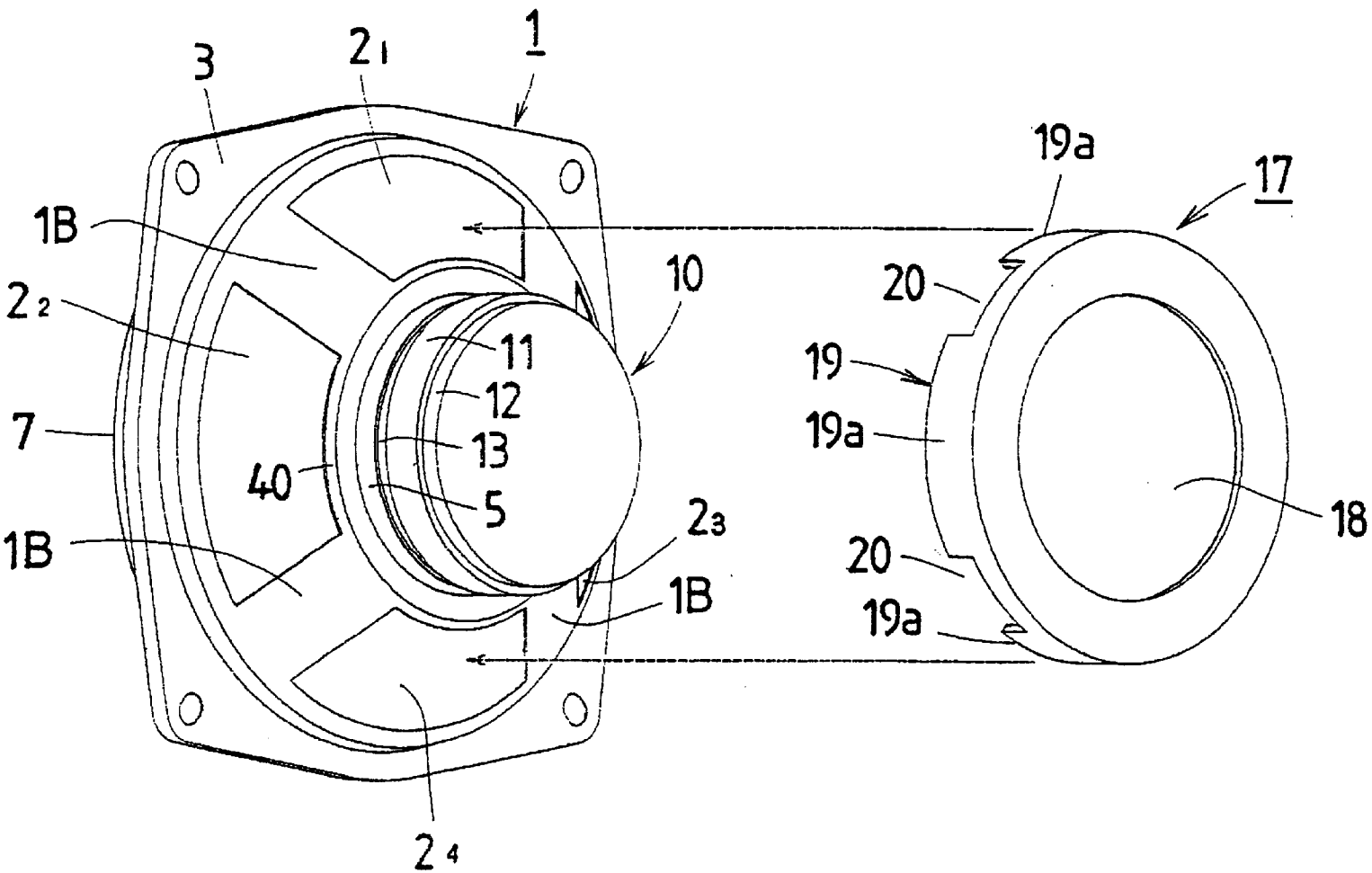
FIG. 8 is an exploded perspective view of a speaker for automobile use with a waterproof member according to an embodiment 4 of the present invention to show their separated state.

FIG. 8 is an exploded perspective view of a speaker for automobile use with a waterproof member according to an embodiment 4 of the present invention to show their separated state.

In the figure, reference numeral 1B denotes supporting portions which are made up of partition wall portions between each of openings $\mathbf{2}_1$–$\mathbf{2}_4$ in a trumpet-shape part of the frame 1. The frame 1 according to this embodiment 4 has the same structure as the conventional one as shown in FIG. 2. Reference numeral 17 denotes a waterproof member which is assembled into the rear face of the small-diameter side of the trumpet-shape part of the frame 1. This waterproof member 17 is made up of a ring member which is angle-shaped in cross section with a central circular opening 18 and an annular peripheral wall 19.

At this point the central circular opening 18 is formed with a diameter substantially equal to the outer diameter of the rear-end annular stepped portion 5 which is formed on the side of the small-diameter end of the trumpet-shape part of the frame 1, and the annular peripheral wall 19 is formed with an inner diameter substantially equal to the outer diameter of the damper-mounting wall portion 40. Therefore, the central circular opening 18 is capable of being fitted into the rear-end annular stepped portion 5 of the frame 1.

Reference numeral 20 denotes fitting crena portions which are formed in the annular peripheral wall 19 by cutting at an equal distance to one another so as to be fitted into each of the supporting portions 1B of the frame 1.

By thus providing the annular peripheral wall 19 of the waterproof member 17 with the fitting crena portions 20 in the same number as that of the supporting portions 1B of the frame 1, the annular peripheral wall 19 serves as intermittent barrier piece portions 19*a* along the circumferential direction. When the waterproof member 17 is assembled into the frame 1, the barrier piece portions 19*a* project beyond each of the openings $\mathbf{2}_1$–$\mathbf{2}_4$.

Next, a description will now be made about the assembling of the waterproof member 17 into the frame 1. By means of fitting the central circular opening 18 of the waterproof member 17 into the rear end annular stepped portion 5 while fitting each of the fitting crena portions 20 of the waterproof member 17 into each of the supporting portions 1B of the frame 1, the waterproof member 17 is assembled and fitted into the frame 1. In the set state, the barrier piece portions 19*a* of the waterproof member 17 project forward through each of the openings $\mathbf{2}_1$–$\mathbf{2}_4$ to thereby enclose the damper 8.

In the speaker for automobile use according to this embodiment 4, the same reference numerals have been attached to the same constituent elements as those in FIGS. 4 and 5 and further descriptions on them have been omitted.

According to the above described embodiment 4, although a separate member in the form of the waterproof member 17 is assembled into the frame 1, this waterproof member 17 is of a simple shape made up of a ring member with an angle shape in cross section and, as compared with the waterproof cover 16 shown in FIG. 3, it is capable of attaining the miniaturization and weight reduction as well as the reduction in cost. There is further an effect that it can be easily fixed in position without the need of screws or the like.

Further, when the waterproof member 17 is assembled and set in position onto the frame 1, there will be attained a state in which the central circular opening 18 of the waterproof member 17 is fitted into the rear-end annular stepped portion 5 of the frame 1 and aligned, as well as a state in which the fitting crena portions 20 of the waterproof member 17 are fitted into the respective supporting portions 1B of the frame 1 and aligned. Therefore, there is an effect that the waterproof member can be stably held on the frame 1 without the need of fixing with screws or the like.

INDUSTRIAL APPLICABILITY

As described above, the speaker for automobile use according to the present invention is suitable as the one with a waterproof structure which restricts the deterioration of the speaker characteristics attributable to the water entering the inside of the door of the automobile.

What is claimed is:

1. A speaker for automobile use comprising:

a frame which is formed into a trumpet shape having a plurality of openings and which is provided on a small-diameter side of the trumpet-shape part with a damper-mounting wall portion extending in a diametrically inward direction;

a damper whose peripheral edge portion is adhered to said damper-mounting wall portion;

a vibrating diaphragm provided so as to extend over a front side of said frame;

and a magnetic circuit unit which is mounted on a rear face side of said frame so as to resonate said damper and said vibrating diaphragm; characterized in:

that said damper-mounting wall portion is formed with a diameter larger than a diameter of said damper; and that an annular eave-shaped barrier wall portion which axially extends toward the front side of said frame so as to enclose a circumference of said damper at a position away from the peripheral edge portion of said damper is integrally formed in a peripheral edge portion of said damper-mounting wall portion;

wherein an upper side of the trumpet-shape part of said frame is formed as a cover wall portion free from an opening.

2. A speaker for automobile use comprising:

a frame which is formed into a trumpet shape having a plurality of openings and which is provided on a small-diameter side of the trumpet-shape part with a damper-mounting wall portion extending in a diametrically inward direction;

a damper whose peripheral edge portion is adhered to said damper-mounting wall portion;

a vibrating diaphragm provided so as to extend over a front side of said frame;

and a magnetic circuit unit which is mounted on a rear face side of said frame so as to resonate said damper and said vibrating diaphragm;

characterized in:

that said damper-mounting wall portion is formed with a diameter larger than a diameter of said damper; and that an annular eave-shaped barrier wall portion which axially extends toward the front side of said frame so as to enclose a circumference of said damper at a position away from the peripheral edge portion of said damper is integrally formed in a peripheral edge portion of said damper-mounting wall portion;

wherein said frame is provided with openings which open at left, right and lower sides respectively, except at an upper side, of the trumpet-shape part, and wherein said damper-mounting wall portion and said barrier wall portion are provided at each lower side thereof with a crena portion which is in continuation of the opening on the lower side.

3. A speaker for automobile use comprising:

a frame which is formed into a trumpet shape having a plurality of openings and which is provided on a small-diameter side of the trumpet-shape part with a damper-mounting wall portion extending in a diametrically inward direction;

a damper whose peripheral edge portion is adhered to said damper-mounting wall portion;

a vibrating diaphragm provided so as to extend over a front side of said frame; and a magnetic circuit unit which is mounted on a rear face side of said frame so as to resonate said damper and said vibrating diaphragm;

characterized in:

that, on a rear side of said damper-mounting wall portion, there is assembled an annular waterproofing member having barrier piece portions each extending axially forward through each of said openings so as to intermittently enclose a circumference of said damper.

4. The speaker for automobile use according to claim 3, wherein said waterproof member is held in position by insertion into an annular stepped portion which is formed in an inner peripheral edge portion of said damper-mounting wall portion and extending axially backward.

5. The speaker for automobile use according to claim 4, wherein said waterproof member has an annular peripheral wall portion and wherein a fitting crena portion for fitting into each of supporting portions between respective openings in said frame are formed at said annular peripheral wall portion.

* * * * *